US009545810B2

(12) United States Patent
Wingkono et al.

(10) Patent No.: US 9,545,810 B2
(45) Date of Patent: Jan. 17, 2017

(54) LOW GRAMMAGE RECORDING MEDIUM

(71) Applicant: Hewlett-Packard Development Company, L.P., Fort Collins, CO (US)

(72) Inventors: Gracy Apprisiani Wingkono, San Diego, CA (US); John L. Stoffel, San Diego, CA (US); Thomas Roger Oswald, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 621 days.

(21) Appl. No.: 13/739,594

(22) Filed: Jan. 11, 2013

(65) Prior Publication Data

US 2014/0198166 A1 Jul. 17, 2014

(51) Int. Cl.

| | |
|---|---|
| ***B41M 5/00*** | (2006.01) |
| ***B41M 5/50*** | (2006.01) |
| ***D21H 11/00*** | (2006.01) |
| ***D21H 17/67*** | (2006.01) |
| ***D21H 17/66*** | (2006.01) |
| ***D21H 25/02*** | (2006.01) |
| ***D21H 17/63*** | (2006.01) |
| ***D21H 23/56*** | (2006.01) |
| ***D21H 17/16*** | (2006.01) |
| ***D21H 17/17*** | (2006.01) |
| ***D21H 17/28*** | (2006.01) |
| ***D21H 21/16*** | (2006.01) |
| *B41M 5/52* | (2006.01) |

(52) U.S. Cl.

CPC ..... *B41M 5/508* (2013.01); *D21H 11/00* (2013.01); *D21H 17/16* (2013.01); *D21H 17/17* (2013.01); *D21H 17/28* (2013.01); *D21H 17/63* (2013.01); *D21H 17/66* (2013.01); *D21H 17/67* (2013.01); *D21H 17/675* (2013.01); *D21H 21/16* (2013.01); *D21H 23/56* (2013.01); *D21H 25/02* (2013.01); *B41M 5/5218* (2013.01); *B41M 5/5236* (2013.01); *B41M 5/5254* (2013.01)

(58) Field of Classification Search

CPC ..... B41M 5/50; D21H 11/00; D21H 17/63; D21H 17/66; D21H 17/67; D21H 17/675; D21H 25/02

USPC ... 428/32.1; 162/70, 91, 181.1, 181.2, 181.4

See application file for complete search history.

(56) References Cited

U.S. PATENT DOCUMENTS

| | | | | |
|---|---|---|---|---|
| 3,878,038 | A | 4/1975 | Opderbeck et al. | |
| 6,679,973 | B2 | 1/2004 | Klass et al. | |
| 2004/0099391 | A1 | 5/2004 | Ching et al. | |
| 2004/0185287 | A1 | 9/2004 | Reighard et al. | |
| 2008/0163993 | A1 | 7/2008 | Varnell | |
| 2010/0167198 | A1* | 7/2010 | Park et al. | 430/119.6 |
| 2010/0173169 | A1* | 7/2010 | Reagan et al. | 428/533 |
| 2011/0104406 | A1 | 5/2011 | Zhou et al. | |
| 2011/0205287 | A1* | 8/2011 | Zhou et al. | 347/20 |

FOREIGN PATENT DOCUMENTS

| | | |
|---|---|---|
| CN | 102186678 | 9/2011 |
| JP | 2004162198 | 6/2004 |
| JP | 2008238772 | 10/2008 |
| JP | 2010221688 | 10/2010 |
| WO | 2008153837 | 12/2008 |
| WO | 2009145790 | 12/2009 |
| WO | 2010036521 | 4/2010 |
| WO | 2010044795 | 4/2010 |

* cited by examiner

*Primary Examiner* — Betelhem Shewareged

(74) *Attorney, Agent, or Firm* — Thorpe, North & Western L.L.P.

(57) ABSTRACT

The present disclosure provides low grammage recording media, and associated methods and systems. In one example, a low grammage recording medium can comprise a raw base paper having a basis weight of 65 gsm or less, the raw base paper comprising wood fiber and 2 wt % to 10 wt % filler including calcium carbonate. A surface treatment solution is applied to the raw base paper and comprises a surface sizing agent and 3 wt % to 15 wt % calcium carbonate.

17 Claims, No Drawings

LOW GRAMMAGE RECORDING MEDIUM

BACKGROUND

There are several reasons that inkjet printing has become a popular way of recording images on various medium surfaces, particularly paper and photo medium substrates. Some of these reasons include low printer noise, capability of high-speed recording, and capability of multicolor recording. Additionally, these advantages can be obtained at a relatively low price to consumers. With respect to inkjet ink chemistry, the majority of commercial inkjet inks are water-based. Thus, their constituents are generally water-soluble, as is the case with many dyes, or water dispersible, as is the case with pigments. Furthermore, inkjet inks have low viscosity to accommodate high frequency jetting and firing chamber refill processes can be typical ink inkjet architecture. Furthermore, inks having positive printing characteristics with respect to inkjet architecture often have less than ideal performance on the printed page, and vice versa.

While various print media has been used in conjunction with inkjet printing, low grammage paper is a challenging print medium in that acceptable runnability, paper physicals, and print quality can be difficult to obtain. As such, there is continued interest in developing certain types of medium that can be used effectively with inkjet printing.

DETAILED DESCRIPTION

It has been recognized that low grammage recording medium can be manufactured to provide excellent printing quality when printed with an inkjet ink. In accordance with this, low grammage recording medium and associated methods described herein are directed to the incorporation and use of filler in the paper making process. It is noted that when discussing the present recording medium, methods and systems, each of these discussions can be considered applicable to each of these examples, whether or not they are explicitly discussed in the context of that example. Thus, for example, in discussing a titanium dioxide in low grammage recording medium, such a titanium dioxide can also be used in a method of making a low grammage recording medium, and vice versa.

Generally, recording media, including low grammage recording media, comprise wood pulp and various additives. However, with low grammage recording media specifically, it can be challenging to obtain good stiffness as well as opacity. To this end, it has been recognized and discovered as described herein that a low grammage recording medium can be manufactured with low levels of filler (titanium dioxide, calcium carbonate, or clay) in the paper making process, and can be further modified with a size press solution containing calcium carbonate and/or titanium dioxide, to provide a low grammage recording medium having desirable stiffness and opacity. Notably, such characteristics can allow for excellent print quality when inkjet printed with an inkjet ink.

Notably, the use of calcium carbonate, or calcium carbonate and titanium dioxide, in a surface treatment solution can provide improved opacity for low grammage recording media without sacrificing stiffness. Additionally, in some examples, the stiffness can be increased. Further, the use of these materials can replace more costly additives making the present media advantageous in print quality as well as cost.

With the above in mind, a low grammage recording medium can generally comprise a raw base paper having a basis weight of 65 gsm or less and a surface treatment solution absorbed into the raw base paper. The raw base paper can comprise wood fiber and from 2 wt % to 10 wt % filler which includes calcium carbonate. Additionally, the surface treatment solution can comprise a surface sizing agent and from 3 wt % to 15 wt % calcium carbonate. As used herein, "low grammage" refers to a recording medium with a raw base paper having a basis weight of 65 gsm or less, unless otherwise specified. In one example, the raw base paper can have a basis weight of less than 60 gsm, and in one aspect, can be less than 55 gsm. Generally, as used herein, the weight percents (wt %) are based on the total weight of the raw base paper when referring to elements in the raw base paper or based on the total weight of the surface treatment solution when referring to elements in the surface treatment solution.

The present low grammage recording medium can provide excellent print quality. As discussed herein, the term "print quality" or "PQ" refers to one or more of the following characteristics: optical density ("print density"), color gamut, strikethrough, and opacity of the medium. In one example, the present recording medium can have excellent opacity. As used herein, "opacity" is measured by TAPPI standard test methods, method T425, unless otherwise specified. In one example, the low grammage recording medium can have an opacity of at least 78. In one aspect, the opacity can be at least 82, or in one specific aspect, at least 85.

Additionally, the present low grammage recording medium can provide excellent processability in printing systems including, for example, high speed printing. Such processability can be correlated with the stiffness of the recording medium. As used herein, "stiffness" is measured by an L&W Bending Tester, 5 degree bending for small flute products, 5 mm strips, unless otherwise specified. Stiffness is reported herein as milli Newtons-meters, unless otherwise specified. Machine Direction (MD) Stiffness is the measure of the force required to bend the sheet in the same orientation as the paper machine flow. Cross Direction (CD) Stiffness is the measure of the force required to bend the sheet in the cross direction orientation of the paper machine flow. In one example, the low grammage recording medium can have a MD stiffness of at least 0.16. In one aspect, the MD stiffness can be at least 0.18, or in another aspect, 0.19. In one specific aspect, the MD stiffness can be at least 0.20.

As discussed herein, the low grammage recording medium generally comprises a raw base paper treated with a solution at the size press of the paper making device. Generally, the raw base paper comprises filler and wood fiber. The filler can include calcium carbonate alone or with other fillers, such as titanium dioxide and/or clay. In one example, the filler includes titanium dioxide and calcium carbonate. Additionally, the raw base paper can include other additives, including internal sizing agents.

Generally, an internal sizing agent is added to the pulp suspension before it is converted to a paper web or substrate to provide internal sizing of the substrate. This internal sizing treatment helps to develop a resistance to liquids in the resulting substrate during use. During further stages of the paper making processing, the internal sizing can also prevent any subsequently-applied surface treatment solutions from substantially soaking into the finished sheet, thereby allowing the surface sizing to generally remain on the surface where it has maximum effectiveness. Internal sizing agents that are suitably used for this purpose include any of those commonly used at the wet end of a paper manufacturing machine. For example, rosin; rosin precipitated with alum ($Al_2(SO_4)_3$); abietic acid and abietic acid homologues such as neoabietic acid and levopimaric acid;

stearic acid and stearic acid derivatives; ammonium zirconium carbonate; silicone and silicone-containing compounds; fluorochemicals of the general structure $CF_3(CF_2)_nR$, wherein R is anionic, cationic or another functional group and n can range from 1 to 1000; starch and starch derivatives; methyl cellulose; carboxymethylcellulose (CMC); polyvinyl alcohol; alginates; waxes; wax emulsions; alkylketene dimmer (AKD); alkenyl ketene dimer emulsion (AnKD); alkyl succinic anhydride (ASA); emulsions of ASA or AKD with cationic starch; ASA incorporating alum; and other known internal sizing agents; and mixtures thereof. The internal sizing agents are generally used at concentration levels known to those who practice the art of paper making. For example, in some applications, the amount of internal sizing agent can be in the range of about 0.3 Kg/T of raw base paper stock to 20 Kg/T.

As discussed herein, the low grammage recording medium generally comprises a surface treatment solution applied to the raw base paper. While the surface treatment solution generally includes calcium carbonate and a first surface sizing agent, the surface treatment solution can also contain titanium dioxide and additional surface sizing agent(s). In one example, the surface sizing agent can be starch or a starch derivative. In another example, the surface treatment solution can include starch and a second surface sizing agent.

Generally, a surface sizing agent aids in the development of resistance to penetration of liquids through the paper substrate and also improves paper surface smoothness. Some suitable surface sizing agents include, but are not limited to, starches and starch derivatives; carboxymethylcellulose (CMC); methyl cellulose; alginates; waxes; wax emulsions; alkylketene dimer (AKD); alkyl succinic anhydride (ASA); alkenyl ketene dimer emulsion (AnKD); emulsions of ASA or AKD with cationic starch; ASA incorporating alum; water-soluble polymeric materials, such as polyvinyl alcohol, gelatin, acrylamide polymers, acrylic polymers or copolymers, vinyl acetate latex, polyesters, vinylidene chloride latex, styrene-butadiene, acrylonitrile-butadiene copolymers, styrene acrylic copolymers and copolymers; and various combinations of these agents. In one example, the surface sizing agent can comprise a starch or starch derivative. Examples of suitable starches are corn starch, tapioca starch, wheat starch, rice starch, sago starch and potato starch. These starch species may be unmodified starch, enzyme modified starch, thermal and thermal-chemical modified starch and chemical modified starch. Examples of chemical modified starch are converted starches such as acid fluidity starches, oxidized starches and pyrodextrins; derivatized starches such as hydroxyalkylated starches, cyanoethylated starch, cationic starch ethers, anionic starches, starch esters, starch grafts, and hydrophobic starches.

Generally, the surface sizing agent can be used at concentration levels customary in the art of papermaking. In one example, the surface sizing agent can be present in surface treatment solution in an amount at from 0.1 wt % to 80 wt %. Additionally, the surface treatment solution can comprise titanium dioxide in an amount at from 1 wt % to 8 wt %. In one aspect, the surface treatment solution can comprise titanium dioxide in an amount at from 4 wt % to 7 wt %.

As discussed above, the raw base paper generally comprises a filler in an amount of 2 wt % to 10 wt %. In one example, the filler can be present in the raw base paper in an amount of 3 wt % to 10 wt %, 4 wt % to 10 wt %, or even 5 wt % to 10 wt %. The amounts of titanium dioxide, calcium carbonate, and clay in the filler can vary. Generally, each component, if present, can be included in an amount ranging from 0.01 wt % to 10 wt %, such that the total amount generally does not exceed 10 wt %. In one example, the titanium dioxide can be at from 0.01 wt % to 1 wt %. In another example, the calcium carbonate can be at from 2 wt % to 9 wt %.

As used herein, the term "wood fiber" refers to cellulosic fibers and other known paper fibers including hardwood pulps and softwood pulps as defined herein. As used herein, the term "hardwood fiber" or "hardwood pulps" refers to fibrous pulp derived from the woody substance of deciduous trees (angiosperms) such as aspen, birch, oak, beech, maple, and eucalyptus. As used herein, the term "softwood fiber" or "softwood pulps" refers to fibrous pulps derived from the woody substance of coniferous trees (gymnosperms) such as varieties of fir, spruce, and pine, as for example loblolly pine, slash pine, Colorado spruce, balsam fir and Douglas fir.

In one example, the raw base paper can contain a mixture of softwood and hardwood fibers. In one example, the raw base paper can contain softwood fibers in an amount at from 0.01 wt % to 70 wt %, if present. In another example, the raw base paper can contain hardwood fibers in an amount at from 30 wt % to 100 wt %. In another aspect, the raw base paper can contain softwood and hardwood fibers in a ratio ranging from about 70:30 to 1:100 by weight.

In addition to the above, the present low grammage recording medium can contain metal salts. Such metal salts are generally added to the surface treatment solution and can improve color gamut as well as color richness. In one example, the salt can include at least one water-soluble metal salt. Suitable metal salts include but not limited to salts of monovalent and multivalent metals selected from the group of Group I metals, Group II metals, Group III metals, transitional metals, and combinations thereof. These metal salts may further include an anion selected from the group consisting of chloride, iodide, bromide, nitrate, sulfate, sulfite, phosphate, chlorate, acetate, formate and combinations thereof. Specific examples thereof include barium chloride, calcium chloride, calcium acetate, calcium nitrate, calcium formate, magnesium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate, and the like. These metal salts may be used alone or in combination of two or more. The metal salt concentration in the surface treatment solution can be any concentration as long as it does not excess the critical saturated concentration. In one example, the metal salt concentration can be from 0.1 wt % to 30 wt %, and in one aspect, from 2 wt % to 10 wt %.

Additionally, a method of making a low grammage recording medium can comprise obtaining a raw base paper as described herein; and applying a surface treatment solution as described herein onto the raw base paper in the paper making process. The step of obtaining can include manufacturing the raw base paper by combining titanium dioxide, calcium carbonate, and wood fibers forming a pulp and pressing the pulp into a raw base paper.

Further, a system for inkjet printing can comprise an inkjet ink loaded in an inkjet cartridge reservoir, and any low grammage recording medium as described herein.

In addition to the elements and additives discussed herein, the low grammage recording medium can further include other additives, such as biocides, viscosity modifiers, materials for pH adjustment, sequestering agents, preservatives, and the like.

Paper brightness and whiteness of the recording medium can be modified as desired. As such, optical brightening agents (OBAs) or fluorescent whitening agents (FWAs) can be added to surface sizing solutions to improve the optical appearance of the paper like brightness or whiteness. OBAs or FWAs are generally compounds that absorb ultraviolet radiant energy at 300-360 nm of the electromagnetic spectrum, and re-emit energy in the visible range mainly in the blue wavelength region (typically 420-470 nm). The term "OBA", as used herein, is interchangeable with "FWA".

Additionally, it is to be understood that this disclosure is not limited to the particular process steps and materials disclosed herein because such process steps and materials may vary somewhat. It is also to be understood that the terminology used herein is used for the purpose of describing particular Examples only. The terms are not intended to be limiting because the scope of the present disclosure is intended to be limited only by the appended claims and equivalents thereof.

It is be noted that, as used in this specification and the appended claims, the singular forms "a," "an," and "the" include plural referents unless the context clearly dictates otherwise.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3.5, and 4 and sub-ranges such as from 1-3, from 2-4, and from 3-5, etc. Additionally, a numerical range with a lower end of "0" can include a sub-range using "0.1" as the lower end point.

EXAMPLES

The following illustrates some examples of the present recording media, methods, and systems that are presently known. However, it is to be understood that the following are only exemplary or illustrative of the application of the principles of the present compositions, methods, and systems. Numerous modifications and alternative compositions, methods, and systems may be devised by those skilled in the art without departing from the spirit and scope of the present compositions, methods, and systems. The appended claims are intended to cover such modifications and arrangements. Thus, while the present recording media, methods, and systems have been described above with particularity, the following examples provide further detail in connection with what are presently deemed to be the acceptable examples.

Example 1

Low Grammage Recording Medium

Six low grammage recording media were prepared having a raw base paper with a basis weight of 60 gsm according to the amount and compositional elements listed in Table 1.

TABLE 1

| Element | Wt % |
|---|---|
| Hardwood Fiber | 67.2 |
| Softwood Fiber | 28.8 |
| Titanium Dioxide | 1 |
| Calcium Carbonate | 3 |

The sheets of the raw base paper as outlined in Table 1 had surface treatment solutions applied thereto, Solution 1 and Solution 2, in an amount of 2 gsm. Specifically, three sheets had Solution 1 and three sheets had Solution 2. Table 2 lists the compositional elements and amounts used for each solution.

TABLE 2

| Element | Solution 1 | Solution 2 |
|---|---|---|
| Calcium Carbonate (g) | 14 | 20 |
| Titanium Dioxide (g) | 4.8 | — |
| Starch (15.2% solids) (g) | 123.7 | 131.6 |
| Total Solution With Water (g) | 200 | 200 |
| pH | 7.47 | 8.86 |
| Viscosity (cP) | 280.8 | 269.2 |
| Calcium Carbonate % in Solution | 7 | 10 |
| Titanium Dioxide % in solution | 2.4 | 0 |
| Total Solids (wt %) | 20.27 | 20.02 |

Example 2

Stiffness and Opacity Data

The low grammage recording media of Example 1 and a comparative low grammage recording medium were tested for stiffness and opacity as listed in Table 3. The comparative low grammage recording medium was prepared according to Example 1 except that it was not surface treated.

TABLE 3

| Recording Medium | CD Stiffness | MD Stiffness | Opacity |
|---|---|---|---|
| Comparable | 0.079 | 0.169 | 77.4 |
| Solution 1 | 0.084 | 0.166 | 78.6 |
| Solution 2 | 0.086 | 0.182 | 77.5 |

As shown in Table 3, the opacity was improved over the comparable for solution 1 and the MD stiffness was improved over the comparable for solution 2. Notably, the opacity improvement did not sacrifice stiffness for solution 1.

Example 3

Low Grammage Recording Media

Low grammage recording media was prepared having a raw base paper with a basis weight of approximately 65 gsm according to the amount and compositional elements listed in Table 4. The Hardwood/Softwood blend also included 1.8 Kg/T of alkylketene dimer (AKD), 2.7 Kg/T of a cationic potato starch (STA-LOK™ 400 from A. E. Staley Mfg. Co.), and 43 Kg/T of hydroxyethyl starch (Penford® Gum 270 from Penford Products Co.)

TABLE 4

| Base Paper | HW/SW | $CaCO_3$ (wt %) | $TiO_2$ (wt %) |
|---|---|---|---|
| 1 | 70/30 | 2.87 | 0.28 |
| 2 | 70/30 | 5.49 | 0.29 |
| 3 | 70/30 | 8.8 | 0.4 |

HW/SW is ratio of hardwood to soft wood

Different sheets of the raw base paper as outlined in Table 4 had two surface treatment solutions applied thereto, Solution 1 and Solution 2, in an amount of approximately 2 gsm. Table 5 lists the compositional elements and amounts used for each solution.

TABLE 5

| Element | Solution 1 | Solution 2 |
|---|---|---|
| Calcium Carbonate (g) | 14 | 20 |
| Titanium Dioxide (g) | 4.8 | — |
| Starch (15.2% solids) (g) | 123.7 | 131.6 |
| Total Solution With Water (g) | 200 | 200 |
| pH | 7.47 | 8.86 |
| Viscosity (cP) | 280.8 | 269.2 |
| Calcium Carbonate % in Solution | 7 | 10 |
| Titanium Dioxide % in solution | 2.4 | 0 |
| Total Solids (wt %) | 20.27 | 20.02 |

Example 4

Stiffness and Opacity Data

The low grammage recording media of Example 3 and a comparative low grammage recording medium were tested for stiffness and opacity as listed in Table 6. The comparative low grammage recording medium was prepared according to Example 3 except that it was not surface treated.

TABLE 6

| Base Paper | Size Press Solution | MD Stiffness | CD Stiffness | Opacity |
|---|---|---|---|---|
| 1 | No coating | 0.201 | 0.091 | 80 |
| 1 | Solution 1 | 0.201 | 0.091 | 88.5 |
| 1 | Solution 2 | 0.201 | 0.091 | 87.8 |
| 2 | No coating | 0.197 | 0.118 | 82 |
| 2 | Solution 1 | 0.197 | 0.118 | 88.8 |
| 2 | Solution 2 | 0.197 | 0.118 | 87 |
| 3 | No coating | 0.172 | 0.113 | 83 |
| 3 | Solution 1 | 0.172 | 0.113 | 87.2 |
| 3 | Solution 2 | 0.172 | 0.113 | 85 |

As shown in Table 6, the opacity was improved over the comparable for solutions 1 and 2. Notably, the opacity improvement did not sacrifice stiffness for the solutions.

While the disclosure has been described with reference to certain examples, those skilled in the art will appreciate that various modifications, changes, omissions, and substitutions can be made without departing from the spirit of the disclosure. It is intended, therefore, that the present disclosure be limited only by the scope of the following claims.

What is claimed is:

1. A low grammage recording medium, comprising:

a raw base paper having a basis weight of 65 gsm or less, the raw base paper, comprising:

a filler in an amount at from 2 wt % to 10 wt %, the filler including calcium carbonate; and wood fiber; and a surface treatment solution applied to the raw base paper, the surface treatment solution, comprising:

calcium carbonate in an amount at from 3 wt % to 15 wt %, and a surface sizing agent.

2. The low grammage recording medium of claim 1, the filler also including titanium dioxide.

3. The low grammage recording medium of claim 1, wherein the surface sizing agent is present in the surface treatment solution in an amount at from 0.1 wt % to 80 wt %.

4. The low grammage recording medium of claim 1, wherein the surface sizing agent is selected from the group of: starches and starch derivatives; carboxymethylcellulose (CMC); methyl cellulose; alginates; waxes; wax emulsions; alkylketene dimer (AKD); alkyl succinic anhydride (ASA); alkenyl ketene dimer emulsion (AnKD); emulsions of ASA or AKD with cationic starch; ASA incorporating alum; polyvinyl alcohol; gelatin; acrylamide polymers; acrylic polymers or copolymers; vinyl acetate latex; polyesters; vinylidene chloride latex; styrene-butadiene; acrylonitrile-butadiene copolymers; styrene acrylic copolymers and copolymers; and mixtures thereof.

5. The low grammage recording medium of claim 1, wherein the surface sizing agent is a starch or starch derivative.

6. The low grammage recording medium of claim 1, wherein the surface treatment solution comprises titanium dioxide in an amount at from 1 wt % to 8 wt %.

7. The low grammage recording medium of claim 1, wherein the surface treatment solution further comprises a metal salt in an amount at from 0.1 wt % to 30 wt %.

8. The low grammage recording medium of claim 1, wherein the low grammage recording medium has an MD stiffness of at least 0.16 and an opacity of at least 78.

9. The low grammage recording medium of claim 1, wherein the low grammage recording medium has an opacity of at least 82.

10. A method of making a low grammage recording medium, comprising applying a surface treatment solution onto a raw base paper, the raw base paper comprising wood fiber and from 2 wt % to 10 wt % of a filler which includes calcium carbonate, the surface treatment solution comprising a surface sizing agent and from 3 wt % to 15 wt % calcium carbonate, wherein the raw base paper has a basis weight of 65 gsm or less.

11. The method of claim 10, wherein the filler further includes titanium dioxide and the surface sizing agent is a starch or starch derivative.

12. The method of claim 10, wherein the surface treatment solution comprises titanium dioxide in an amount at from 1 wt % to 8 wt % and a metal salt in an amount at from 0.1 wt % to 30 wt %.

13. The method of claim 10, wherein the low grammage recording medium has an MD stiffness of at least 0.16.

14. The method of claim 10, wherein the low grammage recording medium has an opacity of at least 82.

15. A system for inkjet printing, comprising:

an inkjet ink loaded in an inkjet cartridge reservoir; and a low grammage recording medium, the low grammage recording medium, comprising:

a filler in an amount at from 2 wt % to 10 wt %, the filler including calcium carbonate; and wood fiber; and a surface treatment solution applied to the raw base paper, the surface treatment solution comprising:

calcium carbonate in an amount at from 3 wt % to 15 wt %, and a surface sizing agent.

16. The low grammage recording medium of claim 1, wherein the amount of filler is from 2 wt % to 4 wt %, including less than about 3 wt % calcium carbonate and less than about 1 wt % titanium dioxide.

17. The low grammage recording medium of claim 16, wherein the low grammage recording medium has an opacity of at least 82.

* * * * *